US011377703B2

(12) United States Patent
Yi et al.

(10) Patent No.: US 11,377,703 B2
(45) Date of Patent: Jul. 5, 2022

(54) STEEL MATERIAL FOR HOT STAMPING, HOT STAMPING PROCESS AND HOT STAMPED COMPONENT

(71) Applicants: Northeastern University, Liaoning (CN); Bengang Steel Plates Co., Ltd., Liaoning (CN)

(72) Inventors: Hongliang Yi, Liaoning (CN); Hongliang Liu, Liaoning (CN); Zhiyuan Chang, Liaoning (CN); Di Wu, Liaoning (CN); Jian Huang, Liaoning (CN); Guodong Wang, Liaoning (CN)

(73) Assignees: Northeastern University, Liaoning (CN); Bengang Steel Plates Co., Ltd., Liaoning (CN)

( * ) Notice: Subject to any disclaimer, the term of this patent is extended or adjusted under 35 U.S.C. 154(b) by 6 days.

(21) Appl. No.: 16/316,257

(22) PCT Filed: Sep. 8, 2016

(86) PCT No.: PCT/CN2016/098411
§ 371 (c)(1),
(2) Date: Jan. 8, 2019

(87) PCT Pub. No.: WO2018/006490
PCT Pub. Date: Jan. 11, 2018

(65) Prior Publication Data

US 2019/0309385 A1 Oct. 10, 2019

(30) Foreign Application Priority Data

Jul. 8, 2016 (CN) ..... 201610535069.3

(51) Int. Cl.
*C21D 8/04* (2006.01)
*C22C 38/04* (2006.01)
(Continued)

(52) U.S. Cl.
CPC ..... *C21D 8/0405* (2013.01); *C21D 8/00* (2013.01); *C21D 8/04* (2013.01); *C21D 8/0421* (2013.01);
(Continued)

(58) Field of Classification Search
None
See application file for complete search history.

(56) References Cited

U.S. PATENT DOCUMENTS

2009/0242086 A1 10/2009 Thomas et al.
2011/0165436 A1 7/2011 Drillet et al.
(Continued)

FOREIGN PATENT DOCUMENTS

CA 2 934 597 A1 7/2015
CA 2 943 652 A1 10/2015
(Continued)

OTHER PUBLICATIONS

Penha et al. "Tempering of Steels." ASM Handbook, vol. 4A, Steel Heat Treating Fundamentals and Processes. pp. 327-351. 2013. (Year: 2013).*
(Continued)

*Primary Examiner* — Brian D Walck
(74) *Attorney, Agent, or Firm* — Fitch, Even, Tabin & Flannery, LLP

(57) ABSTRACT

The present invention relates to a steel material for hot stamping with ultra-fine grains and a process of making the same, a hot stamping process and a hot stamped component. The steel material for hot stamping comprises the following components by weight: 0.27 to 0.40% of C; 0.2 to 3.0% of Mn; 0.11 to 0.4% of V; 0 to 0.8% of Si; 0 to 0.5% of Al; 0 to 2% of Cr; 0 to 0.15% of Ti; 0 to 0.15% of Nb; 0 to 0.004% B; a total of less than 2% of Mo, Ni, Cu and other alloying elements that are beneficial to improving the hardenability,
(Continued)

and other impurity elements. After hot stamping or equivalent heat treatment, the steel material or the formed component of the present invention can achieve a yield strength of 1300 MPa to 1700 MPa, a tensile strength of 1800 to 2200 MPa, and an elongation of 6 to 9% after direct hot stamping quenching and without tempering, which properties cannot be achieved by a material with a composition in the prior art in the situation of direct quenching (no tempering). After the tempering treatment of the present invention, preferably 1500 MPa-1900 MPa-8%, and 1600 MPa-2100 MPa-7% can be reached.

14 Claims, 3 Drawing Sheets

(51) Int. Cl.

| | |
|---|---|
| ***C22C 38/24*** | (2006.01) |
| ***C22C 38/26*** | (2006.01) |
| ***C22C 38/28*** | (2006.01) |
| ***C22C 38/32*** | (2006.01) |
| ***C22C 38/38*** | (2006.01) |
| ***C22C 38/46*** | (2006.01) |
| ***C21D 8/00*** | (2006.01) |
| ***C22C 38/00*** | (2006.01) |

(52) U.S. Cl.
CPC ..... *C22C 38/00* (2013.01); *C22C 38/04* (2013.01); *C22C 38/24* (2013.01); *C22C 38/26* (2013.01); *C22C 38/28* (2013.01); *C22C 38/32* (2013.01); *C22C 38/38* (2013.01); *C22C 38/46* (2013.01)

(56) References Cited

U.S. PATENT DOCUMENTS

| | | | | |
|---|---|---|---|---|
| 2013/0295402 | A1* | 11/2013 | Oh | C21D 1/18 428/551 |
| 2016/0060722 | A1 | 3/2016 | Suwa et al. | |
| 2018/0030567 | A1 | 2/2018 | Yi et al. | |

FOREIGN PATENT DOCUMENTS

| | | | | |
|---|---|---|---|---|
| CN | 100370054 | C | | 2/2008 |
| CN | 101583486 | A | | 11/2009 |
| CN | 101270453 | A | * | 9/2010 |
| CN | 102605261 | A | | 7/2012 |
| CN | 102181795 | A | * | 1/2013 |
| CN | 102906291 | A | | 1/2013 |
| CN | 103392022 | A | | 11/2013 |
| CN | 103993223 | A | | 8/2014 |
| CN | 104846274 | A | | 8/2015 |
| CN | 105074038 | A | | 11/2015 |
| CN | 105518173 | A | | 4/2016 |
| EP | 2 546 375 | A1 | | 1/2013 |
| EP | 2 562 271 | A1 | | 2/2013 |
| EP | 2 660 345 | A2 | | 11/2013 |
| EP | 2 684 972 | A1 | | 1/2014 |
| EP | 3 020 845 | A1 | | 5/2016 |
| EP | 3 040 133 | A1 | | 7/2016 |
| JP | 2006-183139 | A | | 7/2006 |
| JP | 2007-291464 | A | | 11/2007 |
| JP | 2010-174283 | A | | 8/2010 |
| JP | 2010174283 | A | * | 8/2010 |
| JP | 4927236 | B1 | | 5/2012 |
| JP | 2015-113500 | A | | 6/2015 |
| KR | 10-2014-0042110 | A | | 4/2014 |
| WO | 02/103073 | A2 | | 12/2002 |
| WO | 2009/145563 | A2 | | 3/2009 |

OTHER PUBLICATIONS

English language machine translation of CN-101270453-A to Maoqiu et al. Generated Oct. 24, 2020. (Year: 2020).*
English language machine translation of CN-102181795-A to Zhao et al. Generated Oct. 24, 2020. (Year: 2020).*
English language machine translation of JP2010174283 to Kobayashi et al. Generated Feb. 27, 2021. (Year: 2021).*
English language machine translation of KR20140042110 to Lee et al. Generated Feb. 27, 2021. (Year: 2021).*
Yi Hong-liang and Dong Jie-ji, "Hot Press Forming Process and HPF Steel," Shandong Metallurgy, vol. 31, No. 5, Oct. 2009, pp. 17-19, with English Abstract.
Liu Chengbao, Xu Baoyu, Zhu Jingjun, Yi Hongliang, "Study on the Microstructure and Hot Deformation Behavior of a Fe—C—Si—Mn—V Steel," Shandong Metallurgy, vol. 35, No. 2, Apr. 2013, pp. 32-34, with English Abstract.
International Search Report of the State Intellectual Property Office of the Peoples Republic of China dated Apr. 1, 2017 for International Application No. PCT/CN2016/098411 and English Translation, 4 pages.
Bhadeshia, Harshad Kumar Dharamshi Hansraj, "Prevention of Hydrogen Embrittlement in Steels," ISIJ International, 2016, vol. 56, No. 1, pp. 24-36.
European Patent Office, Extended European Search Report dated Feb. 11, 2020 for European Patent Application No. 16907994.4, 12 pages.

* cited by examiner

STEEL MATERIAL FOR HOT STAMPING, HOT STAMPING PROCESS AND HOT STAMPED COMPONENT

CROSS-REFERENCE TO RELATED APPLICATIONS

This application is a U.S. national phase application filed under 35 U.S.C. § 371 of International Application Number PCT/CN2016/098411, filed Sep. 8, 2016, designating the United States, which claims priority from Chinese Patent Application Number 201610535069.3, filed Jul. 8, 2016.

TECHNICAL FIELD

The present invention relates to a steel material for hot stamping with ultra-fine grains, a hot stamping process and a hot stamped component.

BACKGROUND

With the urgent need for global energy conservation and emission reduction and an environmentally friendly economy, the automotive industry is developing in the direction of light weight, but the light weight of an automobile is not at the expense of safety. On the contrary, the collision safety requirements for automobiles are getting higher and higher. At present, high-strength and ultra-high-strength steel materials for vehicles are attracting more and more attention in the automotive industry due to their high strength and light weight. For a high strength, a cold stamping method is adopted, such that the formed properties are reduced, large stamping force is required, and cracking easily occurs. In addition, after being formed, the part rebounds greatly, so that its shape and dimensional accuracy can hardly be guaranteed.

The hot stamping technology arising in Europe is a new forming technology that solves the above problems. The technology is a forming technology that heats the blank to a completely austenitized state, rapidly transfers it to a die having a uniform cooling system to be rapidly stamp formed, and meanwhile performs cooling quenching treatment to obtain a super-high-strength steel part with a uniform martensite structure. At high temperatures, the material has good stamping formability, can be stamp formed into complex members, and at the same time eliminates the rebound impact, such that the part has high precision and good quality. At the present time, major automobile manufacturers in Europe and the United States have successfully applied the high-strength steel material hot stamping technology to the production of members such as an A-pillar, a B-pillar, a bumper, a roof frame, an underbody frame and a door anti-collision bar of an automobile. Due to a high strength and the presence of a martensite structure, the performance of the steel for hot stamping in automotive crash safety depends on its toughness, cold bending property and resistance to delayed cracking. Currently, the steel for hot stamping widely used in the automotive industry is structural alloy steel represented by 22MnB5, which has such problems as high austenitizing temperature (AC3 of about 850° C.), low hardenability, poor toughness after forming, limited cold bending performance, and delayed cracking.

CN100370054C discloses a high-strength steel material for hot stamping coated with an aluminum alloy. The patent document requires a strength of more than 1000 MPa, wherein the strength is 1800 MPa when the carbon content is 0.35%, and the strength reaches 1900 to 2100 MPa or more when the carbon content is above 0.5, but the document does not mention the elongation and toughness thereof. In fact, the material with an alloy design requires tempering heat treatment to achieve the strength value, and has poor toughness, which cannot meet the elongation and toughness requirement of above 1800 MPa of hot stamp formed steel and members, and the high carbon content is detrimental to the welding performance.

CN101583486A discloses a method of preparing a coated strip and a hot stamped product thereof. A preferred embodiment of this document mentions that heat treatment is required after the hot stamping so that its mechanical properties can reach a yield strength of 1200 MPa and a tensile strength of above 1500 MPa, but it does not quantitatively expound the ductility. It only proposes to control the sulfur content (requiring a sulfur content of less than 0.002 wt %) to ensure the ductility and avoid crack propagation caused by sulfide inclusions, but it is difficult and costly in the industry to control the sulfur content below 20 ppm. Hence, by controlling the sulfur element content, the problem of low ductility cannot be completely solved.

SUMMARY

Therefore, in view of the problems in the prior art, one of the objects of the present invention is to improve the deficiencies of the conventional steel material for hot stamping, hot stamping process and hot stamped component, and to provide a steel material for hot stamping with an alloy composition more beneficial to the hot stamping process, as well as a simpler forming process, which can produce a steel material or a formed member having high toughness and delayed crack resistance after the hot stamping without the need of heat treatment such as tempering.

According to an embodiment of the present invention, there is provided a steel material for hot stamping comprising the following components by weight: 0.27 to 0.40% of C; 0.2 to 3.0% of Mn; 0.11 to 0.4% of V; 0 to 0.8% of Si; 0 to 0.5% of Al; 0 to 2% of Cr; 0 to 0.15% of Ti; 0 to 0.15% of Nb; 0 to 0.004% B; a total of less than 2% of Mo, Ni, Cu and other alloying elements that are beneficial to improving the hardenability, and other impurity elements.

The steel material for hot stamping of the present invention has a heating temperature range of 800 to 920° C. during the hot stamping process, and preferably has a composite carbide of VC and/or V with Ti, Nb at the austenite grain boundary during the austenitizing process. In the austenitizing heating process of the steel material for hot stamping of the present invention, the precipitated particle size of the composite carbide of VC and/or V with Ti, Nb at the austenite grain boundary is preferably from 1 to 80 nm. In the hot stamping process, the steel material for hot stamping of the present invention precipitates a certain amount of composite carbide of VC and/or V with Ti, Nb in the austenite crystal including grain boundaries during the cooling after the austenitizing, and a carbide particle size in the austenite crystal is 0.1 to 20 nm. The volume fraction of the composite carbide of VC and/or V with Ti, Nb in the steel material for hot stamping of the present invention is more than 0.1%.

The steel material for hot stamping of the present invention, after the hot stamping, can achieve a yield strength of 1300 MPa to 1700 MPa, a tensile strength of 1800 to 2200 MPa, and an elongation of 6 to 9% without tempering; and can achieve a yield strength of 1350 to 1800 MPa, a tensile strength of 1700 to 2150 MPa, and an elongation of 7 to 10% after tempering heat treatment.

The steel material of the present invention includes a hot-rolled steel sheet, a hot-rolled pickled steel sheet, a cold-rolled steel sheet, or a steel sheet with a coating layer. The steel sheet with a coating layer is a zinc-coated steel sheet which is a hot-rolled steel sheet or a cold-rolled steel sheet on which a metal zinc layer is formed, wherein the zinc-coated steel sheet includes at least one selected from hot dip galvanizing, galvanizing annealing, zinc plating, or zinc-iron plating. The steel sheet with a coating layer is a hot-rolled steel sheet or a cold-rolled steel sheet on which an aluminum-silicon layer is formed, or a steel sheet with an organic coating layer.

In accordance with another embodiment of the present invention, a hot stamping process is provided that can include the following procedures:

(a) steel material austenitizing: providing a steel material for hot stamping having the above-described alloy composition or a preformed member thereof, heating it to 800 to 920° C. and maintaining the temperature for 1 to 10000 s, wherein the heating method in the procedure can be, but not limited to, for example, a roller hearth furnace, a chamber furnace, induction heating, resistance heating;

(b) steel material transferring: transferring the above heated steel material to a hot stamping die while ensuring that the steel material has a temperature of above 550° C. when being transferred to the die;

(c) hot stamping: setting a reasonable press tonnage according to the above-mentioned steel blank size, the stamping pressure being 1 to 40 MPa, determining a dwell time according to a thickness of the plate, which is usually controlled at 4 to 40 s to ensure that a temperature of the member is below 250° C. when the die is opened, for example, a 1.2 mm thick blank has a dwell time of 5~15 s, and a 1.8 mm thick blank has a dwell time of 7~20 s, and controlling a die surface temperature below 200° C. through a cooling system of the die, so that the steel material in the die is rapidly cooled to below 250° C. at an average cooling rate of not less than 10° C./s.

According to still another embodiment of the present invention, there is also provided a tempering process comprising the steps of:

(a) obtaining a formed member by the above-described hot stamping process of the present invention;

(b) during the coating process, heating the formed member to 150 to 200° C. and maintaining the temperature for 10 to 40 minutes; or heating the formed member to 150 to 280° C. at a heating rate of 0.001 to 100° C./s and maintaining the temperature for 0.5 to 120 min, and then cooling it in any way.

The hot stamped component formed by the hot stamping process of the present invention can be used for automotive high-strength members including, but not limited to, an A-pillar, a B-pillar, a bumper, a roof frame, an underbody frame, and a door bumper bar of an automobile.

After hot stamping or equivalent heat treatment, the steel material of the present invention can achieve a yield strength of 1300 MPa to 1700 MPa, a tensile strength of 1800 to 2200 MPa, and an elongation of 6 to 9% after direct hot stamping quenching (without tempering). After the tempering treatment of the present invention, preferably 1500 MPa-1900 MPa-8%, and 1600 MPa-2100 MPa-7% can be reached. This property cannot be achieved by direct quenching (no tempering) of the composition in the prior art.

DETAILED DESCRIPTION

The present invention will be described in more detail below with reference to exemplary embodiments. The following embodiments or experimental data are intended to illustrate the invention exemplarily, and those skilled in the art should be aware that the present invention is not limited to these embodiments or experimental data.

According to an embodiment of the present invention, there is provided a steel material for hot stamping comprising the following components by weight: 0.27 to 0.40% of C; 0.2 to 3.0% of Mn; 0.11 to 0.4% of V; 0 to 0.8% of Si; 0 to 0.5% of Al; 0 to 2% of Cr; 0 to 0.15% of Ti; 0 to 0.15% of Nb; 0 to 0.004% of B; a total of less than 2% of Mo, Ni, Cu and other alloying elements that are beneficial to improving the hardenability, as well as other impurity elements.

Figure 1:
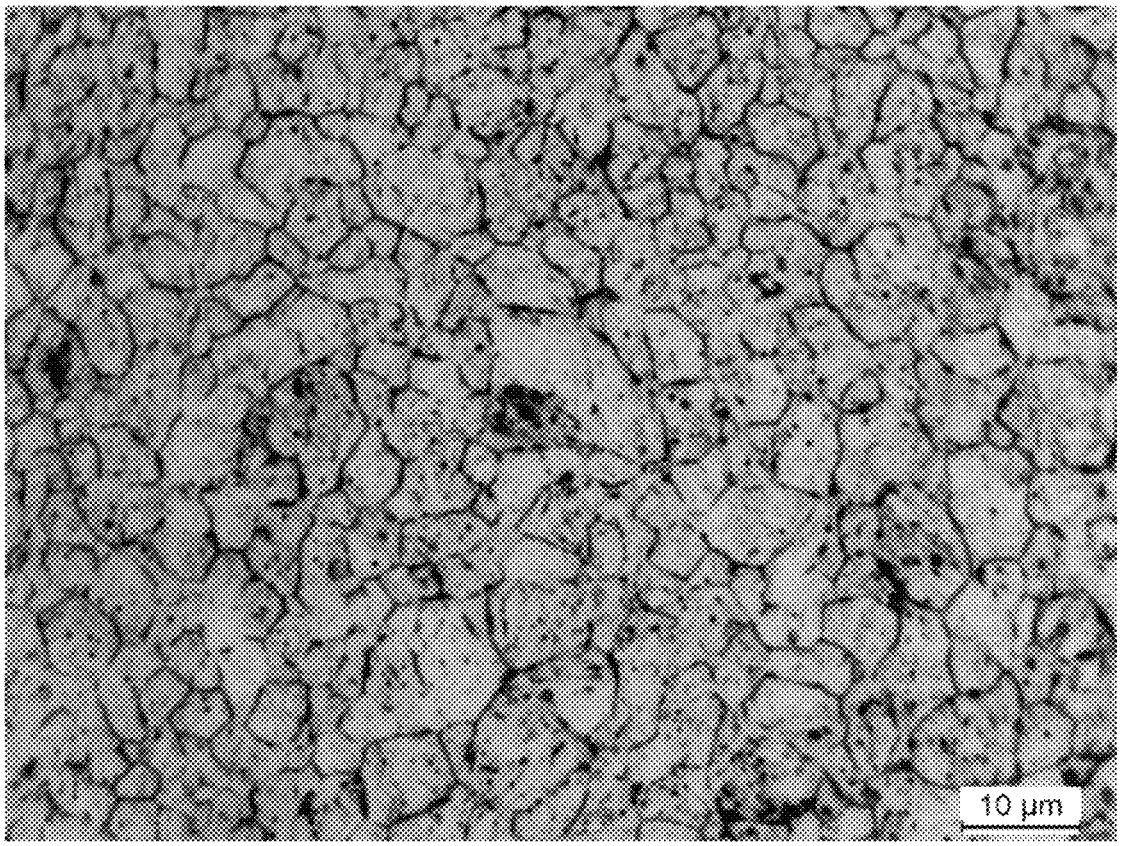
FIG. 1 shows a prior austenite grain boundary morphology of the steel material of the present invention after hot stamping.

The martensite strength improves with increasing carbon content, but high carbon content leads to the formation of twinned martensite, which reduces the toughness of the material. The twinned martensite must be tempered to prevent brittle fracture. The steel material of the present invention adds a specific composition of V element to the alloy composition, so that the full austenitizing heating temperature range during the hot stamping process is 800 to 920° C.; since over 0.11% of V and over 0.27% of C are added to the material, according to the condition of the solubility product of VC precipitation, there will be a certain amount of composite carbide of VC and/or (V, Ti, Nb) C at the austenite grain boundary during the austenitizing process, and the second phase particles effectively pin the austenite grains, which will refine the prior austenite grains. Therefore, the precipitation of VC has an important influence on controlling the size of the prior austenite grains. According to a preferred embodiment of the present invention, the prior austenite grain size is 3 to 6 μm, and the grain refinement and strengthening can not only improve the yield strength but also increase the toughness. FIG. 1 shows a prior austenite grain boundary morphology of the steel material of the present invention after the hot stamping.

If the achievement of a tensile strength of above 1800 MPa only relies on a high carbon addition, the martensite formed contains twinned martensite, such that it has poor toughness and can have ductile fracture only after tempering treatment. After tempering at 170° C. for 20 minutes (usually 170~200° C., 10~30 minutes for automotive coating), the yield strength of the material is increased by 50~100 MPa, the tensile strength is reduced by about 50 MPa, and the elongation can be increased to more than 5%. In the prior art (for example, the material composition and properties publicized by Nippon Steel Corporation): Fe-0.31C-1.3Mn—Ti—B % has an elongation of about 3.5% upon the brittle fracture under the strength of 1700 MPa in the hot stamping state (quenching), and has a strength of 1785 MPa and an elongation of 7% after tempering at 170° C. for 20 minutes. Poor toughness before the tempering increases the risk of delayed cracking of the member; moreover, the automotive member is welded before entering the coating procedure, such that the poor toughness of the member in the hot stamped state (not tempered) tends to cause cracking in the welding assembly process.

Figure 2:
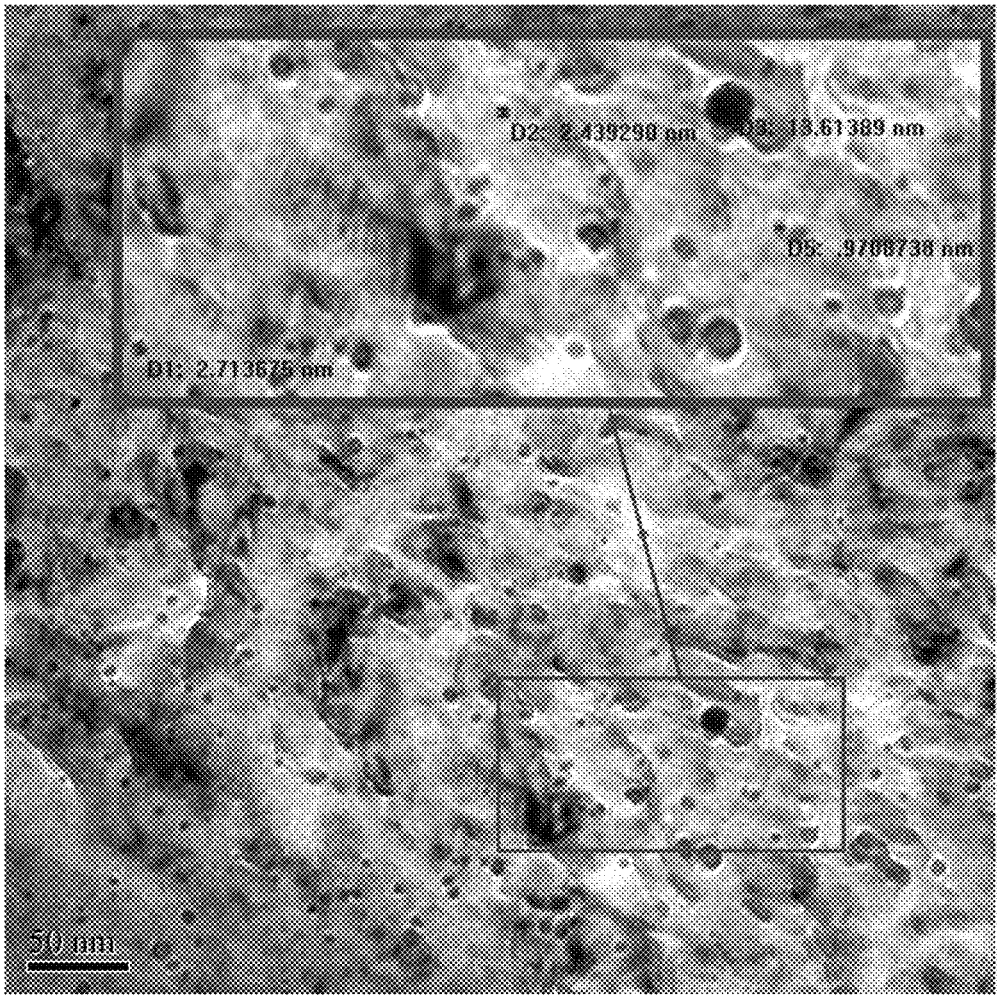
FIG. 2 shows a precipitated particle morphology and size of the steel material of the present invention after hot stamping.

According to the present invention, over 0.11% of V and over 0.27% of C are added to the steel material alloy composition, and VC or (V, Ti, Nb) C with a volume fraction of above 0.1% will be further precipitated during the cooling process of 3 to 30 s after the austenitizing treatment and before the rapid cooling of the hot stamping die, wherein the uniform fine second phase particles can increase the tensile strength by over 100 MPa, and preferably the precipitated particle size is 1~20 nm, the average particle size is 4.5 nm, the volume fraction is about 0.22% (0.22% is calculated from the amount of precipitation in the carbon replica sample by conversion from two-dimension to three-dimension, and the calculated volume fraction of Thermal-Cac is 0.28%), wherein the frequency of occurrence of 1~10 nm is as high as 94.4%, and according to the precipitation strengthening mechanism, the precipitation strengthening enhancement thereof can reach 240 MPa. The precipitation of the VC or (V, Ti) C will consume the carbon in the austenite and reduce its carbon content, thereby decreasing the fraction of twinned martensite formed in the martensite after phase transformation, and therefore, based on the VC precipitation of the present invention, the toughness of the martensite itself can be improved, the strength of the martensite is lowered due to a decrease of the carbon content therein, but the strength of the material is enhanced by VC precipitation strengthening and fine grain strengthening of the prior austenite grains. FIG. 2 shows a precipitated particle morphology and size of the steel material of the present invention after hot stamping.

In addition, VC and H have high binding energy, are an irreversible hydrogen trap and can easily fix hydrogen atoms around them, which can improve the hydrogen-induced delayed cracking ability of the material (Reference: Harshad Kumar Dharamshi Hansraj BHADESHIA. "Prevention of Hydrogen Embrittlement in Steels". ISIJ International, Vol. 56 (2016), No. 1, pp. 24-36).

After hot stamping or equivalent heat treatment, the steel material of the present invention can achieve a tensile strength of 1800 to 2200 MPa, a yield strength of 1300 MPa to 1700 MPa, and an elongation of 9 to 6% after direct hot stamping quenching and without tempering. Preferably, it reaches 1400 MPa-1900 MPa-8%, 1450 MPa-2100 MPa-7%, and the property cannot be achieved by the alloy composition of the prior art upon direct quenching (no tempering); even if the coating process can realize the function of tempering treatment, in order to meet the welding requirement that brittle fracture of the part does not occur in the welding process, tempering heat treatment must be conducted after the hot stamping. In contrast, a major advantage of the present invention is that the process step of tempering heat treatment is eliminated, thereby simplifying the forming process.

The specific manufacturing process of the steel material for hot stamping of the present invention is as follows:

(1) a smelting procedure of smelting strictly according to the above composition by a vacuum induction furnace or a converter;

(2) a heating procedure of heating the smelted steel blank with a temperature of 1100 to 1260° C. and maintaining the temperature for 30 to 600 minutes;

(3) a hot rolling procedure of rolling the steel blank at a temperature below 1200° C., and controlling the final rolling temperature at above 800° C. to obtain a hot rolled steel material;

(4) a crimping step, crimping the above hot-rolled steel material in a temperature region of below 750° C., wherein the structure thereof is mainly ferrite and pearlite. According to actual needs, the above-mentioned hot-rolled steel material can also be pickled to obtain a hot-rolled pickled steel material.

In addition, the above manufacturing process can further include one or more of the following procedures:

(5) a cold-rolled steel material can be obtained after the above hot-rolled steel material is pickled and cold-rolled;

(6) a cold-rolled annealed plate can be produced after the above cold-rolled steel material is annealed;

(7) a surface of the above cold-rolled steel material can be subjected to coating treatment to obtain a coated steel material.

(8) a surface of the above hot-rolled pickled steel material can be subjected to coating treatment to obtain a coated steel material.

Figure 3:
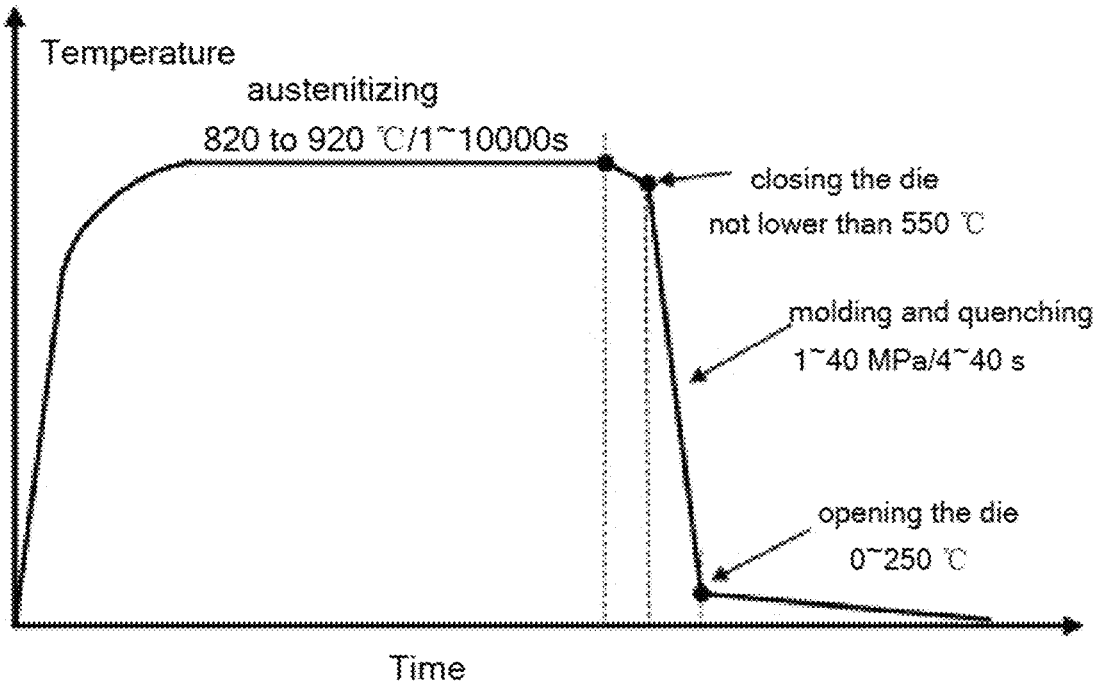
FIG. 3 shows a hot stamping process diagram of a preferred embodiment of the present invention.

FIG. 3 shows a hot stamping process diagram of a preferred embodiment of the present invention. According to a preferred embodiment of the present invention, the hot stamping process of the invention can include the following procedures:

(a) steel material austenitizing: providing any kind of steel material for hot stamping or preformed member thereof according to a first aspect of the invention, heating it to 800 to 920° C. and maintaining the temperature for 1 to 10000 s, wherein the heating method is not limited, and can be, but not limited to, a roller hearth furnace, a chamber furnace, induction heating, resistance heating.

(b) steel material transferring: for example, the heated steel material is usually transferred to a hot stamping die using, but not limited to, a manipulator or a robot to ensure that the steel material has a temperature of above 550° C. when transferred to the die.

(c) hot stamping: setting a reasonable press tonnage according to the above-mentioned steel blank size, the stamping pressure being 1 to 40 MPa, determining a dwell time according to a thickness of the plate, which is controlled at 4 to 40 s to ensure that a temperature of the member is below 250° C. when the die is opened, for example, a 1.2 mm thick blank has a dwell time of 5~15 s, and a 1.8 mm thick blank has a dwell time of 7~20 s, and controlling a die surface temperature below 200° C. through a quenching cooling system of the die, so that the steel material in the die is rapidly cooled to below 250° C. at an average cooling rate of not less than 10° C./s.

The following are exemplary experimental data of the steel material of the present invention. It should be apparent to those skilled in the art that these data are merely exemplary, and the specific components and manufacturing processes of the present invention are not limited thereto.

TABLE 1

Exemplary components of a steel material (UFT-PHS1800) of the present invention

| | Chemical components (% by weight) | | | | |
|---|---|---|---|---|---|
| Steel No. | C | Mn | Si | V | Ti/Nb/Mo |
| IS1 | 0.31 | 1.52 | 0.21 | 0.11 | |
| IS2 | 0.29 | 1.62 | 0.22 | 0.16 | 0.02Ti |

TABLE 1-continued

| Exemplary components of a steel material (UFT-PHS1800) of the present invention | | | | | |
|---|---|---|---|---|---|
| | Chemical components (% by weight) | | | | |
| Steel No. | C | Mn | Si | V | Ti/Nb/Mo |
| IS3 | 0.30 | 1.65 | 0.19 | 0.16 | |
| IS4 | 0.31 | 1.09 | 0.17 | 0.18 | 0.2Mo |
| IS5 | 0.32 | 1.65 | 0.21 | 0.18 | |
| IS6 | 0.33 | 1.62 | 0.20 | 0.25 | |

TABLE 1-continued

| Exemplary components of a steel material (UFT-PHS1800) of the present invention | | | | | |
|---|---|---|---|---|---|
| | Chemical components (% by weight) | | | | |
| Steel No. | C | Mn | Si | V | Ti/Nb/Mo |
| IS7 | 0.36 | 1.45 | 0.16 | 0.39 | 0.03Nb |
| CS1 (comparative steel material) | 0.31 | 1.65 | 0.2 | | |

TABLE 2

| Parameters of the hot stamping process (1.5 mm thick plate) | | | | | | | |
|---|---|---|---|---|---|---|---|
| Steel No. | Sample No. | Austenitizing temperature and thermal insulation time | Press tonnage and die temperature | Sample temperature upon die opening/° C. | Dwell time/s | Sample temperature upon die closing/° C. | 170° C./20 minutes or not |
| IS1 | ISP1 | 850° C./ 5 minutes | 200 tons/ 60° C. | 687 | 10 S | 87 | No |
| | ISP2 | 900° C./ 5 minutes | 200 tons/ 60° C. | 703 | 10 S | 95 | No |
| IS2 | ISP3 | 850° C./ 5 minutes | 200 tons/ 60° C. | 708 | 10 S | 96 | No |
| | ISP4 | 900° C./ 5 minutes | 200 tons/ 60° C. | 688 | 10 S | 111 | No |
| IS3 | ISP5 | 850° C./ 5 minutes | 200 tons/ 60° C. | 697 | 10 S | 122 | No |
| | ISP6 | 900° C./ 5 minutes | 200 tons/ 60° C. | 714 | 10 S | 122 | No |
| | ISP7 | 850° C./ 5 minutes | 200 tons/ 60° C. | 683 | 10 S | 155 | Yes |
| | ISP8 | 900° C./ 5 minutes | 200 tons/ 60° C. | 745 | 10 S | 126 | Yes |
| IS4 | ISP9 | 850° C./ 5 minutes | 200 tons/ 60° C. | 709 | 10 S | 126 | No |
| | ISP10 | 900° C./ 5 minutes | 200 tons/ 60° C. | 706 | 10 S | 126 | No |
| IS5 | ISP11 | 850° C./ 5 minutes | 200 tons/ 60° C. | 673 | 10 S | 139 | No |
| | ISP12 | 900°/ 5 minutes | 200 tons/ 60° C. | 721 | 10 S | 136 | No |
| IS6 | ISP13 | 850° C./ 5 minutes | 200 tons/ 60° C. | 659 | 10 S | 121 | No |
| | ISP14 | 900° C./ 5 minutes | 200 tons/ 60° C. | 683 | 10 S | 143 | No |
| IS7 | ISP15 | 850° C./ 5 minutes | 200 tons/ 60° C. | 688 | 10 S | 91 | No |
| | ISP16 | 900° C./ 5 minutes | 200 tons/ 60° C. | 695 | 10 S | 103 | No |
| CS1 | CSP1 | 850° C./ 5 minutes | 200 tons/ 60° C. | 677 | 10 S | 125 | No |
| | CSP2 | 900° C./ 5 minutes | 200 tons/ 60° C. | 650 | 10 S | 114 | No |
| | CSP3 | 850° C./ 5 minutes | 200 tons/ 60° C. | 677 | 10 S | 125 | Yes |
| | CSP4 | 900° C./ 5 minutes | 200 tons/ 60° C. | 650 | 10 S | 114 | Yes |

TABLE 3

| Mechanical property results (tensile testes: 1.5 mm thick plate, sample JIS5 samples; Stacked Charpy V-notched impact tests: 3*1.5 mm stacked samples, TD means transverse direction, RD means rolling directon) | | | | | |
|---|---|---|---|---|---|
| Steel No. | Sample No. | UTS/MPa | YS/MPa | TEL/% | $\alpha_k$/J cm$^2$ (TD/RD) |
| IS1 | ISP1 | 1870 ± 20 | 1262 ± 37 | 7.0 ± 0.89 | 48/54 |
| | ISP2 | 1822 ± 9 | 1204 ± 1 | 7.4 ± 0.14 | 56/60 |

TABLE 3-continued

Mechanical property results (tensile testes: 1.5 mm thick plate, sample JIS5 samples; Stacked Charpy V-notched impact tests: 3*1.5 mm stacked samples, TD means transverse direction, RD means rolling directon)

| Steel No. | Sample No. | UTS/MPa | YS/MPa | TEL/% | $\alpha_k$/J cm$^2$ (TD/RD) |
|---|---|---|---|---|---|
| IS2 | ISP3 | 1891 ± 4 | 1338 ± 33 | 7.9 ± 0.2 | 44/55 |
| | ISP4 | 1919 ± 9 | 1315 ± 9 | 7.1 ± 0.29 | 52/61 |
| IS3 | ISP5 | 1924 ± 1 | 1360 | 7.1 ± 0.3 | 45/56 |
| | ISP6 | 1873 ± 10 | 1341 | 7.2 ± 0.16 | 54/63 |
| | ISP7 | 1870 ± 23 | 1431 | 7.5 ± 0.24 | 45.5/58.9 |
| | ISP8 | 1818 ± 1 | 1425 | 7.3 ± 0.09 | 53.7/73.9 |
| IS4 | ISP9 | 1689 ± 11 | 1125 ± 5 | 8.2 ± 0.54 | 56/62 |
| | ISP10 | 1678 ± 8 | 1178 ± 15 | 8.3 ± 0.21 | 58/67 |
| IS5 | ISP11 | 1944 ± 32 | 1258 ± 8 | 7.2 ± 0.38 | 57.9/62.9 |
| | ISP12 | 1990 ± 8 | 1364 ± 12 | 7 ± 0.31 | 51/63.5 |
| IS6 | ISP13 | 1989 ± 2 | 1360 ± 66 | 7.7 ± 0.59 | 49.7/51.5 |
| | ISP14 | 2020 ± 2 | 1336 ± 1 | 8 ± 0.1 | 52.1/62.3 |
| ISP7 | ISP15 | 2202 ± 15 | 1508 ± 32 | 6.9 ± 0.42 | 47/55 |
| | ISP16 | 2185 ± 26 | 1486 ± 45 | 7.0 ± 0.34 | 48.5/57 |
| CS1 | CSP1 | 1857 ± 39 | 1359 | 5.9 ± 0.11 | 50/41 |
| | CSP2 | 1798 ± 23 | 1238 | 5.2 ± 0.04 | 41.5/52.5 |
| | CSP3 | 1796 ± 1 | 1369 | 6.92 ± 0.66 | 42/51 |
| | CSP4 | 1702 ± 20 | 1374 | 6.3 ± 0.16 | 43/53 |
| 22MnB5 (Al—Si) | No tempering | 1565 ± 29 | 1132 ± 27 | 7.5 ± 0.49 | 51.1/59.6 |

TABLE 4

Mechanical property results of various portions of a U-shaped test piece of 30MnBV steel after hot stamping (1.5 mm thick plate, no tempering treatment, hot stamped state)

| Position | Heating temperature (° C.) | Thermal insulation time (minutes) | Die temperature (° C.) | Dwell time (s) | Tensile strength (MPa) | Yield strength (MPa) | Elongation (%) |
|---|---|---|---|---|---|---|---|
| Flange | 850 | 5 | 80 | 12 | 1836 ± 3 | 1233 | 7.8 ± 0.8 |
| Wall portion | 850 | 5 | 80 | 12 | 1801 ± 1 | 1213 | 8.0 ± 0.2 |
| Bottom portion | 850 | 5 | 80 | 12 | 1869 ± 12 | 1243 | 6.9 ± 0.6 |

TABLE 5

Mechanical property results of various portions of a test piece of a part (door anti-collision beam) after hot stamping (1.5 mm thick plate, the tempering process being a simulated coating process, heating at 170° C. and holding the temperature for 20 minutes)

| Position | Heating temperature (° C.) | Thermal insulation time (minutes) | Die temperature (° C.) | Dwell time (s) | Tempered | Tensile strength (MPa) | Yield strength (MPa) | Elongation |
|---|---|---|---|---|---|---|---|---|
| Bottom portion | 850 | 5 | 80 | 10 | Not tempered | 2030 ± 10 | 1424 ± 21 | 6.1 ± 0.1 (A50) |
| | | | | | Tempered | 1922 ± 4 | 1514 ± 19 | 7.2 ± 0.02 (A50) |
| Bottom portion | 875 | 5 | 80 | 10 | Not tempered | 2010 ± 8 | 1414 ± 16 | 6.9 ± 0.1 (A50) |
| | | | | | Tempered | 1921 ± 7 | 1510 ± 29 | 8.3 ± 0.1 (JIS5) |

The preferred embodiments of the present invention have been described above, but it should be understood by those skilled in the art that any possible variation or substitution made without departing from the concept of the present invention falls into the scope of protection of the invention.

What is claimed is:

1. A hot stamped component produced with a steel material for hot stamping, wherein the steel material for hot stamping comprises the following components by weight:

iron;

0.27 to 0.40% of C;

0.2 to 3.0% of Mn;

0.11 to 0.4% of V;

0 to 0.8% of Si;

0 to 0.5% of Al;

0 to 2% of Cr;

0 to 0.15% of Ti;

0 to 0.15 of Nb;

0 to 0.004% of B;

a total of less than 2% of Mo, Ni, Cu; and inevitable impurity elements, after a hot stamping process, the hot stamped component achieves a yield strength of 1300 MPa to 1700 MPa, a tensile strength of 1800 to 2200 MPa, and an elongation of 6 to 9% without tempering;

wherein the hot stamped component comprises precipitated carbide of VC and/or composite carbide of V with Ti, Nb within austenite grains, a carbide size within the austenite grains being 0.1 to 20 nm, a total volume fraction of carbide of VC and/or composite carbide of V with Ti, Nb in the hot stamped component is more than 0.1%.

2. The hot stamped component according to claim 1, wherein the hot stamped component is austenitized at a temperature range of 800 to 920° C. during a hot stamping process, and has a composite carbide of VC and/or V with Ti, Nb at an austenite grain boundary during an austenitizing process.

3. The hot stamped component according to claim 2, wherein in the austenitizing process of the hot stamped component, a precipitated particle size of the composited carbide of VC and/or V with Ti, Nb at the austenite grain boundary is from 1 to 80 nm.

4. The hot stamped component according to claim 2, wherein in the hot stamping process, the hot stamped component precipitates a certain amount of carbide of VC and/or composite carbide of V with Ti, Nb within the austenite grains precipitating during the austenitizing process or during a cooling process after austenitizing, and a carbide size within the austenite grains is 0.1 to 20 nm.

5. The hot stamped component according claim 2, wherein after the hot stamping, the hot stamped component is subjected to a tempering heat treatment and achieves a yield strength of 1350 to 1800 MPa, a tensile strength of 1700 to 2150 MPa, and an elongation of 7 to 10% after tempering heat treatment.

6. The hot stamped component according to claim 1, wherein the steel material for hot stamping includes a hot-rolled steel sheet, a hot-rolled pickled steel sheet, a cold-rolled steel sheet, or a steel sheet with a coating layer.

7. The hot stamped component according to claim 6, wherein the steel sheet with a coating layer is a zinc-coated steel sheet which is a hot-rolled steel sheet or a cold-rolled steel sheet on which a metal zinc layer is formed, wherein the zinc-coated steel sheet includes at least one selected from hot-dip galvanizing, galvanizing annealing, zinc plating, or zinc-iron plating.

8. The hot stamped component according to claim 6, wherein the steel sheet with a coating layer is a hot-rolled steel sheet or a cold-rolled steel sheet on which an aluminum-silicon layer is formed, or a steel sheet with an organic coating layer.

9. A hot stamping process, comprising the following procedures:

(a) steel material austenitizing: providing a steel material for hot stamping according to claim 1 or a preformed member thereof, heating it to 800 to 920° C. and maintaining the temperature for 1 to 10000 s;

(b) steel material transferring: transferring the above heated steel material to a die for hot stamping while ensuring that the steel material has a temperature of above 550° C. when being transferred to the die;

(c) hot stamping: setting a reasonable press tonnage according to the above-mentioned steel blank size, the stamping pressure being 1 to 40 MPa, determining a dwell time according to a thickness of the plate, which is controlled at 4 to 40 s, and controlling a die surface temperature below 200° C. through a cooling system of the die, so that the steel material in the die is rapidly cooled to below 250° C. at an average cooling rate of not less than 10° C./s.

10. The hot stamping process according to claim 9, wherein a heating method in the procedure (a) comprises a roller hearth furnace, a chamber furnace, induction heating, and resistance heating.

11. A tempering process, comprising the steps of:

(a) obtaining a formed component by the hot stamping process of claim 9;

(b) heating the formed component to 150 to 200° C. and maintaining the temperature for 10 to 40 minutes by the baking process during carbody assembly; or heating the formed component to 150 to 280° C. at a heating rate of 0.001 to 100° C./s and maintaining the temperature for 0.5 to 120 minutes, and then cooling it in any way.

12. The hot stamped component according to claim 1, wherein properties thereof reach a yield strength of 1300 MPa to 1800 MPa, a tensile strength of 1700 to 2150 MPa, and an elongation of 7 to 10%.

13. The hot stamped component according to claim 1, wherein the hot stamped component can be used for automotive high-strength members including an A-pillar, a B-pillar, a bumper, a roof frame, an underbody frame, and a door bumper bar of an automobile.

14. The hot stamped component according to claim 1, wherein the hot stamped component is made of a blank of steel for hot stamping having a thickness of 1.2-1.8 mm.

* * * * *